United States Patent [19]

Ackerfeldt et al.

[11] 4,142,563

[45] Mar. 6, 1979

[54] GOLF BAG

[75] Inventors: Bo I. Ackerfeldt, Ascona, Switzerland; Curt Olsson, Bandhagen; Carl-Göran Crafoord, Bromma, both of Sweden

[73] Assignee: Sikob Svensk Industris Konstruktions-Och Berakningskontor AB, Sollentuna, Sweden

[21] Appl. No.: 739,536

[22] Filed: Nov. 3, 1976

[51] Int. Cl.[2] ..... A63B 55/00

[52] U.S. Cl. ..... 150/1.5 C; 150/1.5 R

[58] Field of Search ..... 150/1.5 R, 1.5 B, 1.5 C; 248/96; 273/32, 62, 77

[56] References Cited

U.S. PATENT DOCUMENTS

| | | | |
|---|---|---|---|
| 1,973,819 | 9/1934 | Link | 150/1.5 C |
| 2,007,696 | 7/1935 | Siebert | 150/1.5 C |
| 3,373,911 | 3/1968 | Kebelbeck | 150/1.5 C |

FOREIGN PATENT DOCUMENTS

| | | | |
|---|---|---|---|
| 376897 | 7/1932 | United Kingdom | 150/1.5 C |
| 705115 | 3/1954 | United Kingdom | 150/1.5 R |
| 714316 | 8/1954 | United Kingdom | 150/1.5 R |
| 780347 | 7/1957 | United Kingdom | 150/1.5 R |
| 864624 | 4/1961 | United Kingdom | 150/1.5 R |
| 980829 | 1/1965 | United Kingdom | 150/1.5 R |

*Primary Examiner*—Ro E. Hart

*Attorney, Agent, or Firm*—Haseltine, Lake & Waters

[57] ABSTRACT

A golf bag comprises a high, relatively narrow container with rigid walls of a hard material, preferably a plastics material, for accommodating the clubs and separate storage bags, which can be detachably fastened to the outside of the container. The container has a uniform cross-section over its entire length and is closed with a bottom at its lower end, whereas the upper end is open for insertion of the shafts of the clubs. The interior of the container is preferably divided into several elongated, narrow, parallel compartments for accommodating the shaft of one club each. The peripheral wall of the container is provided with at least two, parallel, external key-grooves extending in the longitudinal direction of the container, and each separate storage bag is provided with two, parallel, external key-ribs with a key-section corresponding to that of the key-grooves in the peripheral wall of the container, whereby the storage bag can be detachably fastened to the outside of the container in that the key-ribs on the storage bags are inserted in axial direction into the key-grooves in the peripheral wall of the container.

8 Claims, 3 Drawing Figures

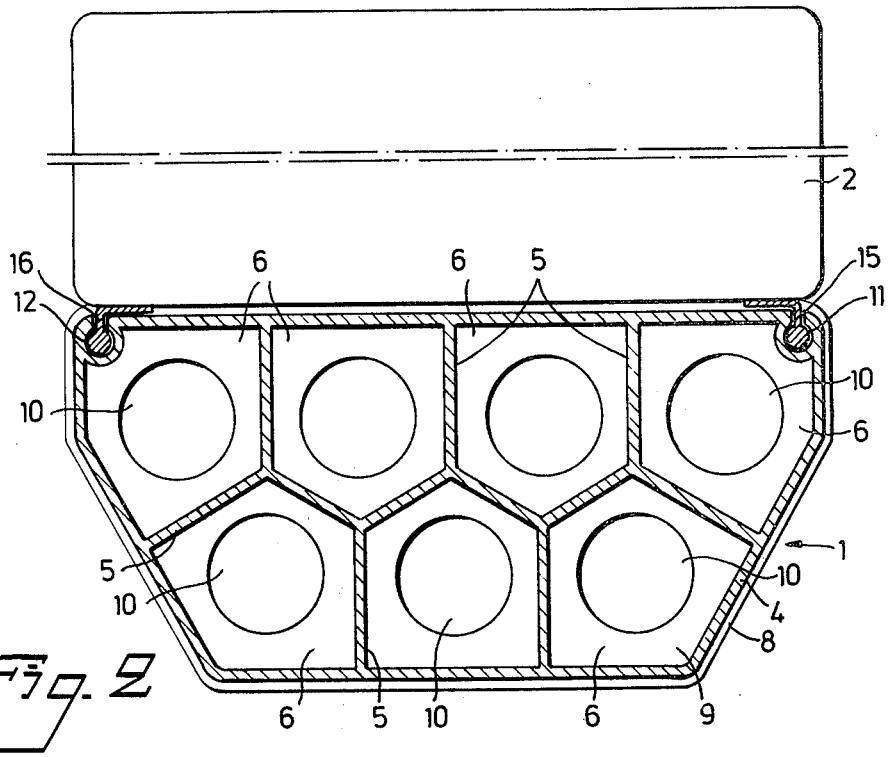
Fig. 2
Fig. 3
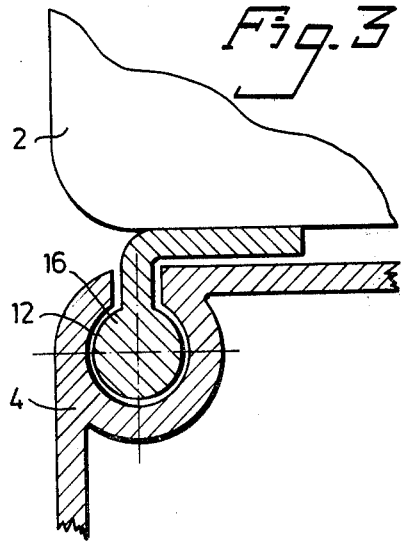
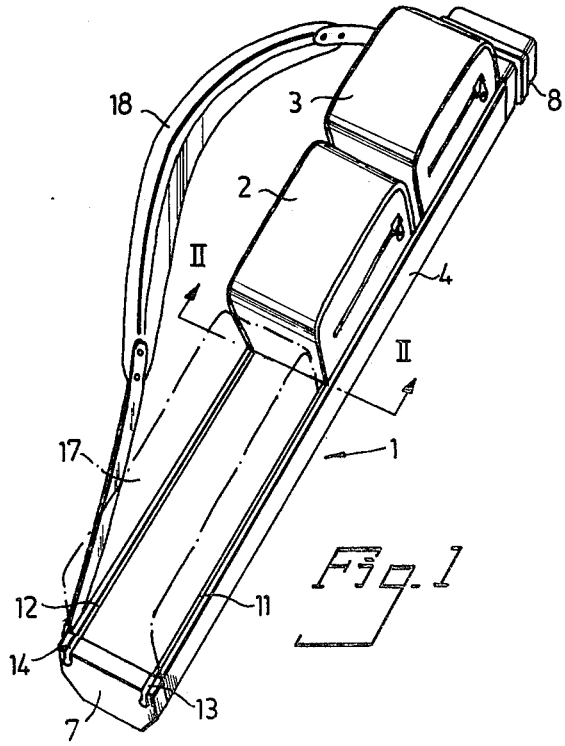
Fig. 1

GOLF BAG

This invention relates to a golf bag for the transport and storage of golf clubs. The traditional and most common type of golf bags consists of a high, as compared to its height relatively narrow bag having a circular or somewhat oval cross-section and provided with a strong bottom at its lower end, whereas the upper end is completely open. In this bag the clubs are inserted with their shafts, and the height of the bag is such that substantially only the heads of the clubs protrude from the bag at its upper open end. Further, the bag is generally provided with at least one and in most cases several outer pockets for holding balls, tees, rainwear, extra clothes and any other accessories that the player may wish to bring along when playing or during transport to and from a golf course. Such a traditional golf bag is made of leather, a strong fabric or nowadays usually plastics-coated fabric, and in most cases reinforcements in the form of steel wires, steel strips or similar are fitted into the walls of the bag in order to give it a required stability. The manufacture of such a conventional golf bag involves a very large number of operations for cutting out the various pieces of material and putting them together, which is mostly done by stitching. The major part of these operations must be carried out more or less manually, wherefore the production costs are comparatively high and very sensitive to increased labour costs. These prior art golf bags are also comparatively heavy and clumsy and in spite of this not particularly durable. They are also rather impractical, as to keep the clubs inserted in the bag in better order and also to protect the shafts of the clubs against chafing one has to provide the bag with an insert of plastic tubes in which the shafts of the clubs can be inserted. In some cases the bag is provided with such an insert of plastic tubes already by the manufacturer, whereas in other cases the player himself must acquire suitable plastic tubes and arrange them in a convenient manner within the bag. These plastic tubes increase the actual cost of the bag additionally and to some extent also its weight.

The object of the present invention is therefore to provide an improved golf bag, which is more simple and less expensive to manufacture and also lighter in weight and more durable than conventional golf bags of the common type described above.

The golf bag according to the invention is characterized in that the portion of the bag intended for the accommodation of the clubs consists of a high, as compared to its height relatively narrow container having a bottom at its lower end and being open at its other end and which has completely rigid walls of a hard material, preferably a hard plastics material. Such a rigid container of plastics material can be designed to have a comparatively low weight but in spite of this a large strength so as to be very durable. Further, it can easily be manufactured substantially completely mechanically, wherefore the manufacturing costs can be reduced. It can also be provided with internal partition walls made at the same time and in one piece with the peripheral walls so that these partition walls divide the interior of the container into several, narrow, parallel compartments, in which the shafts of the clubs can be inserted so that the clubs are kept in order and their shafts are protected against chafing.

Such a rigid plastic container can preferably be made of a cut-off section of suitable length from a multiple-channel tube of a suitable plastics material. Such a multiple-channel tube can be manufactured by extrusion and a cut-off length thereof will form the peripheral walls as well as the internal partition walls of the container of the golf bag according to the invention. One end of this multiple-channel tube is closed with a bottom plate, which may preferably also consist of plastics material and which can be glued to the tube. The opposite end of the tube, which shall form the open end of the container, is preferably provided with a reinforcement collar, which preferably consists also of plastic and is glued to the tube.

One problem with such a golf bag consisting of a rigid container of hard plastics material is the provision of necessary storage bags or pockets on the outside of the container. According to the invention this problem is solved in that the golf bag according to the invention comprises, in addition to the above-mentioned rigid container for the accommodation of the clubs, also one or several separate storage bags which can be detachably mounted on the outside of the rigid container. These external storage bags or pockets are releasably attached to the plastic container in a very simple and efficient manner in that the peripheral wall of the rigid container is provided with at least two, parallel, external grooves extending in the longitudinal direction of the container. These grooves have a key-section i.e. they are narrower at their opening than at their bottom. Further, each storage bag is on its rear side provided with two, parallel, external ribs having a corresponding key-section, whereby the storage bags can be fastened on the outside of the plastic container in that the key-ribs on the bags are inserted in axial direction into the key-grooves in the peripheral wall of the container.

In the following the invention will be described in more detail with reference to the accompanying drawing, which shows by way of example an embodiment of golf bag according to the invention. In the drawing FIG. 1 is a perspective view of a golf bag according to the invention with two external storage bags mounted on the outside of the club container, which has room for additionally one or two external storage bags, if desired;

FIG. 2 shows a cross-section through the golf bag along the line II—II in FIG. 1; and FIG. 3 is a partial cross-section at a larger scale illustrating the manner of attaching the external storage bags to the outside of the club container.

The golf bag according to the invention shown by way of example in the drawing comprises a high, comparatively narrow, rigid container for the clubs, which container is generally designated with 1, and two separate, external storage bags or pockets 2 and 3 detachably fastened to the container 1.

The rigid container 1 for the clubs consists of a multiple-channel tube 4 of a suitable hard or stiff plastic material. This plastic tube has the cross-section shown in FIG. 2 and forms consequently the rigid peripheral walls of the container 1 and also a number of internal partition walls 5, which divide the interior of the tube 4 and thus of the container 1 into a number of elongated, narrow, parallel compartments 6. In each of these compartments the shaft of a golf club can be inserted. Consequently, the golf bag according to the invention illustrated by way of example in the drawing is intended for accomodating seven golf clubs, and the internal partition walls 5 are arranged in such a pattern that they define two rows of compartments 6, one row along each of the two parallel peripheral walls of the container 1 or tube 4. The internal partition walls 5 contribute also to imparting high stability and strength to the tube 4 and thus to the container 1, even if the partition walls 5 as well as the peripheral walls of the tube 4 are comparatively thin. In this way a strong as well as light-weight structure is obtained.

The lower end of the tube 4 is closed with a bottom plate 7 which is preferably made of a strong, impact-resistant plastics material and which is glued to the tube 4. This bottom plate 7 is preferably provided with a protruding flange or collar along its circumference, which collar encloses and thereby strengthens the lower end of the tube 4. The bottom plate 7 is preferably also provided with drainage openings not shown in the drawing, whereby water is prevented from collecting in the lower portion of the container 1.

The upper end of the tube 4 is provided with a reinforcement collar 8, which is made of a suitable plastics material and which encloses the upper end of the tube 4 and is glued thereto. This reinforcement collar 8 may preferably consist of a flange along the circumference of a plate 9, which covers the upper end of the tube 4 (compare FIG. 2) and which is provided with a circular hole or aperture 10 opposite each compartment 6 in the tube 4. This circular holes 10 in the plate 9 have a sufficient diameter so that the club shafts can easily be inserted into the compartments 6 of the container 1 through these holes. The plate 9 with the holes 10 helps to space the clubs in the container so that the club heads protruding from the upper end of the container do not chafe against each other too much. The plate 9 may also be made of a somewhat resiliant plastics material or alternatively the edges of the holes 10 in the plate 9 may be provided with a lining of a more resiliant plastics material, whereby a noise reducing effect is achieved in that the rattle of the clubs in the container 1 is eliminated or reduced.

The external storage bags or packets 2 and 3 may be made of any suitable material, for instance a strong fabric, plastics-coated fabric, leather or a similar material. They are detachably fastened to the club container 1 in that the peripheral wall of the plastic tube 4 is on the larger plane side of the tube provided with two, parallel, longitudinally extending, open grooves 11 and 12, which extend over the entire length of the multiple-channel plastic tube 4. As can be most readily seen in FIGS. 2 and 3, these grooves 11 and 12 have a key-section, i.e. they are narrower at their opening than at their bottom. As can be seen in FIG. 1, the bottom plate 7 is also provided with corresponding grooves 13 and 14 which form extensions of the grooves 11 and 12 in the peripheral wall of the tube 4. Each of the external storage bags 2 and 3 is on its rear side, i.e. the side intended to be facing the club container 1, provided with two parallel ribs 15 and 16 which have a key-section corresponding to that of the key-grooves 11 and 12 in the peripheral wall of the container tube 4. These ribs 15 and 16 can for instance consist of homogeneous plastic ribs of a rigid or somewhat flexible plastics material or of metal ribs, which are attached to the storage bag in any suitable manner, for instance by stitching or riveting. Thus, the storage bags 2 and 3 are attached to the club container 1 in that the key-ribs 15 and 16 on the storage bags are inserted at the lower end of the club container in axial direction into the key-grooves 11 and 12 in the peripheral wall of the club container 1.

It will be appreciated that this method of removably attaching the external storage bags to the rigid plastic container 1 is very efficient and also very advantageous as to the manufacturing costs, as the key-grooves 11 and 12 can easily be made simultaneously with the production, for instance by extrusion, of the multiple-channel plastic tube 4. It will also be appreciated that this method of attaching the external storage bags to the plastic container makes it possible for the golfer to choose the size as well as the number of storage pockets on his golf bag. The golf bag shown by way of example in the drawing is provided with two comparatively small storage pockets 2 and 3, each having a height corresponding to about one quarter of the total height of the club container 1, but as indicated with dotted lines the club container 1 can, if desired, be provided additionally with one large storage pocket 17 twice as large or alternatively, of course, with two additional storage pockets of the same size as the storage pockets 2 and 3.

When the desired storage bags have been put in place as described above, the lower ends of the key-grooves 11 and 12 are closed, for instance in that plugs of suitable shape are inserted and locked into the grooves 13 and 14 in the bottom plate 7. These grooves may for instance be provided with internal threads so that screw plugs can be used. If the key-grooves 11 and 12 in the wall of the container 24 are not utilized in their entire length for the attachment of storage bags, the remaining portions of the key-grooves are preferably filled with inserted metal rods or similar members, whereby the storage bags mounted on the container tube 4 are kept in their desired positions.

It will be appreciated that this arrangement for mounting the external storage bags on the outside of the club container makes it possible for the buyer or owner of a golf bag according to the invention to choose, according to his wishes and taste, the number of storage bags as well as their size and design, for instance colour, if the manufacturer supplies bags in various sizes, designs and colours.

It is obvious that the design of the external storage bags can vary extensively, for instance with respect to the position of the openings to the bags and the closure means for these openings.

The golf bag according to the invention illustrated in FIG. 1 is also provided with a detachable shoulder strap 18 which can be connected to suitable connecting means attached to the bottom plate 7 and the reinforcement collar 8 respectively.

We claim:

1. A golf bag for storage and transport of golf clubs, comprising a high, in comparison to its height relatively narrow container having rigid peripheral walls of a stiff material, preferably a plastics material, and a bottom at its lower end and being open at its upper end, in which container golf clubs can be inserted with their shafts so that substantially only the heads of the clubs protrude from the container at its upper open end, at least one separate storage bag, and means for detachably mounting said storage bag on the outside of said container, said mounting means including at least two, parallel, external key-grooves in the peripheral wall of said container extending in the longitudinal direction of the container and at least two, parallel, external key-ribs on the rear side of said storage bag, whereby the storage bag can be detachably mounted on the outside of said container in that said key-ribs on the storage bag are inserted in axial direction into said key-grooves in the peripheral wall of the container.

2. A golf bag as claimed in claim 1, comprising two or several separate storage bags of the kind defined, which can be inserted with their said key-ribs one after the other into said key-grooves in the peripheral wall of said container so as to form a row of storage bags attached one above the other on the outside of the container.

3. A golf bag as claimed in claim 1, wherein said or each storage bag is made of a flexible material, as plastics-coated fabric, fabric, leather or a similar material.

4. A golf bag as claimed in claim 1, wherein said container comprises a, preferably extruded, multiple-channel tube of a hard plastics material forming the peripheral wall of the container and internal partition walls dividing the interior of the container into several, elongated, narrow, parallel compartments for accommodating the shaft of one golf club each, a bottom plate fastened to one end of said tube and substantially closing said one end of the tube, and a collar enclosing and strengthening the peripheral rim of the opposite end of said tube.

5. A golf bag as claimed in claim 4, wherein said collar is constituted by an axially protruding flange along the circumference of a plate covering said second end of the tube, said plate being provided with an opening opposite each of said compartments in said tube.

6. A golf bag as claimed in claim 4, wherein said bottom plate is provided with an axially protruding flange along its circumference, said flange enclosing and strengening said one end of said tube.

7. A golf bag as claimed in claim 4, wherein said multiple-channel tube has a cross-section with a substantially trapezoidal circumference and said internal partition walls divide the interior of said cross-section into a first row of compartments along the longer one of the two parallel sides of said trapezoidal circumference and a second row of compartments along the opposite side of the trapezoidal circumference, the number of compartments in said second row of compartments being one less than in said first row of compartments, and the compartments in said second row of compartments being located opposite to the partition walls between the compartments in said first row of compartments.

8. A golf bag as claimed in claim 7, wherein said compartments have a substantially pentagonal cross-section.

* * * * *